United States Patent [19]

Randell et al.

[11] 4,163,731

[45] Aug. 7, 1979

[54] FIRE RESISTANT FUNCTIONAL FLUID COMPOSITIONS BASED ON PHOSPHATE ESTERS AND SUBSTITUTED AROMATIC COMPOUNDS

[75] Inventors: Donald R. Randell, Stockport; Thomas G. Hyde, Sale; Frank Lamb, Bury; Brian G. Clubley, Sale; William D. Phillips, Stockport, all of England

[73] Assignee: Ciba-Geigy AG, Basel, Switzerland

[21] Appl. No.: 846,223

[22] Filed: Oct. 26, 1977

[30] Foreign Application Priority Data

Oct. 28, 1976 [GB] United Kingdom ..... 44752/76

[51] Int. Cl.[2] ..... C10M 3/40

[52] U.S. Cl. ..... 252/78.5; 252/49.8; 252/49.9; 252/63.7; 252/73; 252/78.1

[58] Field of Search ..... 252/78.5, 49.8, 49.9, 252/73, 63.7, 78.1

[56] References Cited

U.S. PATENT DOCUMENTS

| | | | |
|---|---|---|---|
| 3,115,466 | 12/1963 | Orloff et al. | 252/78.5 X |
| 3,941,709 | 3/1976 | Herber et al. | 252/78.5 |
| 3,992,309 | 11/1976 | Donchis | 252/78.5 X |

FOREIGN PATENT DOCUMENTS

| | | |
|---|---|---|
| 1184533 | 3/1970 | United Kingdom . |
| 1353249 | 5/1974 | United Kingdom . |
| 1483681 | 8/1977 | United Kingdom . |

*Primary Examiner*—Harris A. Pitlick
*Attorney, Agent, or Firm*—Luther A. R. Hall

[57] ABSTRACT

Functional fluid composition comprising an ester of a phosphorus acid and a compound of the formula I $$R(CH_2X)_n \qquad (I)$$

in which R represents an aromatic hydrocarbon or heterocyclic containing residue, n is an integer of at least 2, and each X is the same or different and represents a leaving group, which composition may be used for a wide variety of purposes, for example in hydraulic machinery employed in foundries and mines, in hydraulic systems for aircraft, in turbines and as fluids in electrical equipment and in heat transfer devices.

16 Claims, No Drawings

FIRE RESISTANT FUNCTIONAL FLUID COMPOSITIONS BASED ON PHOSPHATE ESTERS AND SUBSTITUTED AROMATIC COMPOUNDS

The present invention relates to functional fluids and in particular to functional fluid compositions having improved fire retardance.

The main classes of fire-resistant functional fluids in general industrial use are water/glycol solutions, oil-in-water and water-in-oil emulsions, and phosphate esters. The choice of a particular type of fluid for a given application is determined primarily by the severity of operating conditions and for highly hazardous environments triaryl phosphates are preferred on account of their high stability and low volatility. Fire resistance is, however, a misleading term since most materials will burn under certain conditions.

In view of a continuing increase in the severity of operating conditions, hydraulic fluids are being subjected to higher operating temperatures and pressures which could increase the risk of flammability in the event of a leakage or a pipe fracture. It is possible that the equipment using these fluids could be modified to reduce the heat loading imposed on the fluid, but this would be extremely expensive. A far more desirable solution would be to increase the 'fire resistance' of the fluid.

It is accordingly the object of this invention to provide functional fluids compositions with improved fire resistance.

Accordingly the present invention provides a functional fluid composition comprising an ester (a) of a phosphorus acid and a compound (b) of the formula I $$R(CH_2X)_n \qquad (I)$$

in which R represents an aromatic hydrocarbon or heterocyclic containing residue, n is an integer of at least 2, and each X is the same or different and represents a leaving group.

In the compounds of formula I, each aromatic or heterocyclic ring may contain from 0 to 6 $—CH_2X$ groups, preferably 1 to 3 and most preferably 1, provided that there are at least 2 $—CH_2X$ groups per molecule.

Thus n may be from 2 to 12, preferably from 2 to 6 and, most preferably, from 2 to 4.

The aromatic nucleus preferably has a free ortho position next to the $—CH_2X$ group and the $CH_2X$ group is preferably positioned so as not to allow intramolecular cyclisation.

Group X in formula I is halogen, —OH, —SH, $—NH_2$, $—CO_2H$, $—PO_3H_2$, $OB(OH)_2$ and their derivatives, for example $—OR^1$, $—SR^1$, $—NHR^1$, $—NR^1R^2$, $—OB(OR^1)(OR^2)$. Non-limiting examples of such derivatives and other X groups may be represented by the general formulae

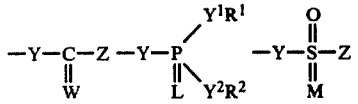

where

Y, $Y^1$ and $Y^2$ are, independently, —O—, —NH—,

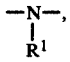

—S—, or are absent, but preferably are —O—or —S—

Z is H, $R^1$, $OR^1$, $—SR^1$, $NH_2$, $NHR^1$, $NR^1R^2$ or a direct bond linking

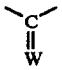

back to R or to a $CH_2$ attached to R but preferably is H or $R^1$;

W is O, S, NH or $NR^1$, but preferably is O or S;

L is O, S or is absent, but preferably is O;

M is O or is absent, but preferably is O; and wherein $R^1$ represents a straight or branched chain alkyl having 1 to 12 carbon atoms, preferably 1 to 4, but most preferably 1, alkenyl or alkynyl having 2 to 12 carbon atoms, preferably 2 to 4, cycloalkyl or cycloalkenyl having 5 to 12, preferably 6 carbon atoms, aralkyl, aralkenyl or alkaryl having 7 to 12 carbon atoms, preferably benzyl or naphthyl methyl or aryl having 6 to 15, preferably 6 to 12 carbon atoms, most preferably phenyl or naphthyl. $R^1$ may be optionally substituted by one or more halogen, hydroxy, epoxy, nitrile, amine, amide, ether, carboxyl or ester groups or combinations thereof, but is preferably unsubstituted. $R^2$ has the same significance as $R^1$ and may be the same or different. The leaving group may also be a salt of an acidic or basic X group.

However, of the non-limiting examples, compounds of formula I where X=OH or a derivative of this group are preferred.

The aromatic residue R may be mono-, di-, or polycyclic and these may be condensed or non-condensed. It may be a mixture of condensed and non-condensed groups. Where more than one separate aromatic residue is present they may be linked directly or through groups containing carbon or hetero atoms or groups containing combinations of carbon and hetero atoms. These linking groups may also be chosen so as to produce repeating aryl or heterocyclic groups in which the connecting function or functions are $—CH_2X$ groups in which X contains $R^1$ and/or $R^2$, at least one of which is an R or $—CH_2R$ group. The group R may, therefore, be an oligomer, containing the above mentioned aromatic hydrocarbon and heterocyclic residues, formed by addition or condensation reactions. When such connecting functions are present, however, it is preferred that other non-connecting $—CH_2X$ functions are also present in the system.

The connecting functions are preferably short chain groups preferably with not more than 3 carbon atoms. More preferably the connecting functions do not have contiguous C atoms. The group R may be otherwise unsubstituted or it may be substituted by one or more halogen atoms or alkyl groups having 1 to 12 carbon atoms, preferably 1 to 4, alkenyl or alkynyl groups having 2 to 12 carbon atoms, preferably 2 to 4, cycloalkyl groups having 5 to 12 carbon atoms, hydroxyl groups, alkoxy groups having 1 to 12, preferably 1 to 4, carbon atoms which may contain an epoxide group, cycloalkoxy groups having 5 to 12 carbon atoms, acyloxy groups having 1 to 12, preferably 1 to 4, carbon atoms, carboxyl groups or carboalkoxy groups having 2 to 12, preferably 2 to 4, carbon atoms or mixtures thereof. However, R is preferably an otherwise unsubstituted or $C_1$–$C_{12}$ alkyl, preferably methyl, substituted di-, tri-, or tetracyclic residue. Most preferably, R is an otherwise unsubstituted di-, tri-, or tetracyclic aromatic residue.

When the compounds of formula I are oligomers they have the general formula:

$$(A)_a(-CH_2-)_b[-CH_2(OCH_2)_eOCH_2-]_c(-CH_2X)_d \quad \text{IIa}$$

wherein A is at least one aromatic hydrocarbon or heterocyclic residue, X is OH or a derivative thereof, a is 2 to 20 but equals b+c+1, b is 0 to 19, c is 0 to 19, d is 0 to 2*a* and e is 0 to 10, preferably 0–5, most preferably 0, there being at least two ($-CH_2X$) groups per molecule, the group ($-CH_2OCH_2-$) counting as ($-CH_2X$) for this purpose.

It should be noted that the values of a, b, c, d and m are average values for the average molecule of formula IIa.

Examples of aromatic residues A are benzene, naphthalene, furan, anthracene, biphenyl and diphenyl ether. The aromatic residue A may be unsubstituted or substituted by one or two substituents. It is preferably unsubstituted, but if it is substituted it preferably carries only one substituent. Suitable substituents include halogen, alkyl groups with 1 to 4 carbon atoms, haloalkyl groups with 2 to 4 carbon atoms, and the group $OR^3$ where $R^3$ is hydrogen, alkyl with 1 to 4 carbon atoms or acyl with 1 to 4 carbon atoms.

The compounds represented by formula IIa are mixtures of oligomers with a range of molecular weights. The residues A are linked by ($-CH_2-$) or [$-CH_2(OCH_2)_eOCH_2-$] groups, these two linking groups being connected only to a residue A and not to each other. The groups ($-CH_2X$) are connected to a residue A. Thus compound I can be an oligomer or co-oligomer, for example an oligomer can be naphthalene based and a co-oligomer based on naphthalene and diphenyl ether.

Preferably greater than 50 mol % of residues A are derived from naphthalene; most preferably more than 75 mol % of residues A are derived from naphthalene.

Oligomers which are preferred are those having a number average molecular weight of 300 to 3500, more preferably those having a number average molecular weight of 350–1500, most preferably 400 to 1000. It is preferred that the naphthalene residues are linked by ($-CH_2OCH_2-$) and that these links should be attached to the positions 1,4; 1,5; 1,6; 1,7; 2,5; 2,6 or 2,7 on the naphthalene residue. It is most preferred that the links should be attached to the 1,4 or 1,5 positions on the naphthalene residue.

The liquid phosphorus acid esters include derivatives of phosphoric acid, phosphonic acid and phosphinic acid, but esters of phosphoric acid are preferred.

The phosphorus acid esters used in the compositions preferably have the general formula II

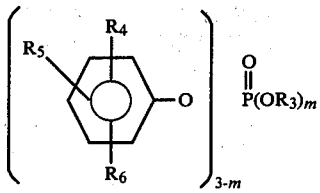

(II)

in which m is an integer from 0–3 and $R_4$ and $R_5$ and $R_6$ which may be the same or different are hydrogen, alkyl groups having 1 to 9 carbon atoms, cyclo alkyl groups having 6 to 12 carbon atoms, halo-alkyl groups having 1 to 9 carbon atoms excluding halomethyl and containing one or more chlorine atoms, chlorine, aryl groups having 6 to 10 carbon atoms, aralkyl groups having 7 to 12 carbon atoms and $R_3$ is an alkyl group having 1 to 16 carbon atoms, or a haloalkyl group containing one or more chlorine atoms. In formula II m is preferably 0 or 1. $R_4$, $R_5$ and $R_6$ are preferably hydrogen, alkyl or aralkyl groups, or combinations of these, providing that the phosphate or mixture of phosphates is liquid at ambient temperatures.

In formula II non-limiting examples of $R_3$ are 2-chloroethyl, 2-chloropropyl, 2,3-dichloropropyl n-butyl, t-butyl, -octyl, decyl, hexadecyl and $R_4$, $R_5$ and $R_6$ are methyl, ethyl, n-propyl, isopropyl, secbutyl, t-butyl, octyl, nonyl, cyclohexyl, 1-methyl cyclohexyl, 2-chloroethyl, chloropropyl, dichloropropyl, trichloroisopropyl, benzyl and methyl benzyl, α,α-dimethyl benzyl or mixtures thereof.

Preferably, at least one of $R_4$, $R_5$ and $R_6$ is a methyl, isopropyl, tert-butyl or tert-nonyl group.

In formula I, the group X is preferably a group OH, $OR^1$, OCOH or $OCOR^1$ where $R^1$ is as defined above, but is preferably methyl, phenyl or benzyl. In formula I non-limiting examples of residue R include those derived from the following systems:

where R is monocyclic (1) benzene
(2) toluene
(3) xylenes
(4) ethyl benzene
(5) mesitylene
(6) durene
(7) isodurene
(8) ψ-cumene or cumene
(9) anisole
(10) phenyl acetate
(11) chlorobenzene
(12) bromobenzene
(13) pyridine
(14) triazine
(15) pyrimidine
(16) pyrazine
(17) p-t-butyl phenol Preferably R is derived from residues 1–9.

where R is non-condensed bicyclic (1) biphenyl
(2) diphenylmethane
(3) 1:1-diphenylethane
(4) 1:2-diphenylethane
(5) 2:2-diphenylpropane
(6) diphenylcarbinol (7) benzophenone
(8) phenyl benzoate
(9) diphenylacetic acid (and its esters)
(10) diphenylether
(11) diphenylacetonitrile
(12) diphenylsulphide
(13) diphenyldisulphide
(14) diphenylsulphoxide
(15) diphenylsulphone
(16) diphenylamine
(17) N,N-diphenylmethylamine
(18) diphenylmethyl phosphine
(19) diphenyl methyl phosphine oxide
(20) diphenyl octyl phosphate
(21) dipyridyl
(22) $3,3^1$-dimethyl biphenyl
(23) $2,2^1$-dimethyl biphenyl
(24) $4,4^1$-dimethyl biphenyl
(25) $2,2^1$-diphenyl dicarboxylic acid
(26) stilbene
(27) benzoin
(28) benzil
(29) benzilic acid
(30) dibenzyl sulphate
(31) dibenzyl oxalate
(32) dibenzyl succinate
(33) diphenyl carbonate
(34) octyl di-styryl phosphinate
(35) ferrocene Of these we prefer residues derived from nos. 1, 2, 10 and 15.

where H is condensed bicyclic (1) naphthalene
(2) methyl naphthalene
(3) methoxy naphthalene
(4) tetralin
(5) quinoline
(6) isoquinoline
(7) quinoxaline
(8) quinazoline
(9) phthalazine
(10) phthalimide
(11) indole
(12) benzofuran
(13) benzimidazole
(14) benzothiazole
(15) benzotriazole Of these we prefer naphthalene and methyl naphthalene where R is non-condensed tricyclic (1) terphenyl
(2) triphenyl methane
(3) dibenzyl benzene
(4) $O,O^1$-diphenyl hydroquinone
(5) $O,O^1$-diphenyl resorcinol
(6) triphenylamine
(7) triphenyl phosphine
(8) triphenyl phosphine oxide
(9) triphenyl phosphate
(10) tricresyl phosphate
(11) trixylyl phosphate
(12) isopropyl phenyl/phenyl phosphates
(13) triphenyl antimony
(14) tribenzyl phosphate
(15) diphenyl styryl phosphonate
(16) triphenyl orthoformate Of these we prefer residues derived from nos. 1, 2, 3, 5, 6, 8, 9, 10, 11 and 12.

where R is condensed tricyclic (1) anthracene
(2) phenanthrene
(3) phenyl naphthalene
(4) acenaphthene
(5) acenaphthylene
(6) dihydroanthracene
(7) anthrene
(8) xanthene
(9) xanthone
(10) fluorene
(11) fluorenone
(12) acridine
(13) phenanthridine
(14) phenazine
(15) benzocinnoline
(16) carbazole
(17) dibenzofuran
(18) dibenzothiophene
(19) phenothiazine
(20) phenoxazine
(21) $\alpha$-methylstyrene dimer
(22) styrene dimer
(23) biphenylene
(24) 1-methylanthracene Of these we prefer residues derived from nos. 1, 2, 3, 4, 5, 10 16, 17, 21, 22 and 24 where R is non-condensed tetracyclic (1) quaterphenyl
(2) tetraphenylmethane
(3) triphenyl benzene
(4) 2,4,6-triphenyl triazine
(5) $N,N^1N^{11}$-triphenyl melamine
(6) $N,N^1N^{11}$-triphenyl isocyanurio acid
(7) tetraphenyl tin
(8) tetraphenyl lead
(9) tetraphenyl ethane
(10) tetrabenzyl orthosilicate
(11) 2,4,6 triphenoxy triazine
(12) tetraphenyl silicate Of these we prefer residues derived from nos. 2, 4, 5, 6 and 11.

where R is condensed tetracyclic (1) dinaphthyl
(2) phenyl anthracene
(3) phenyl phenanthrene
(4) N-phenyl acridone
(5) N-phenyl carbazole
(6) N-phenyl phenothiazine
(7) N-phenyl phenoxazine
(8) 9-phenyl acridine
(9) 2:3-diphenyl quinoxaline
(10) triphenylene
(11) aceanthrene
(12) pyrene
(13) naphthacene
(14) fluoranthene
(15) chrysene
(16) dinaphthyl methane Of these we prefer residues derived from dinaphthyl and N-phenyl carbazole.

where R is polycyclic higher than tetracyclic (1) 9,10-diphenyl anthracene
(2) sexiphenyl
(3) rubrene
(4) 9,9-diphenyl xanthene
(5) 9,9-diphenyl acridane
(6) hexacene
(7) hexaphene
(8) pyranthrene where R is a polymer or oligomer (1) poly-p phenylenes
(2) poly (methylene phenylenes)
(3) poly-xylenes
(4) polybenzyl ethers
(5) polybenzyl esters
(6) polyphenyl ethers
(7) polyphenyl esters
(8) polystryene
(9) poly-α-methyl styrene
(10) polynaphthalenes
(11) polymethylenenaphthalenes
(12) poly (arylene-di-methylene) ethers of the type $H—(Ar.CH_2.O.CH_2)_n\ Ar—H$ where Ar represents the group

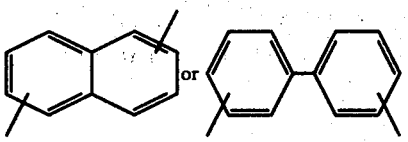

and n is as previously defined

In formula I non limiting examples of group X are:

$—Cl, —Br, —OH, —OCH_3, —OC_2H_5,$
$—OCH_2CH{=}CH_2, OCH_2C{\equiv}CH$

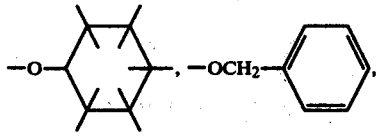

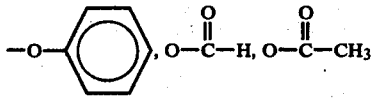

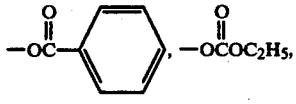

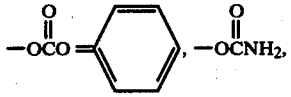

$—OCNHCH_3, —OCN(CH_3)_2,$
$—OCNHCH_3, —OCN(CH_3)_2,$

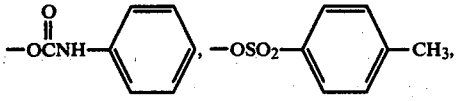

-continued

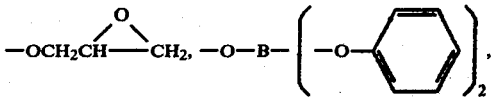

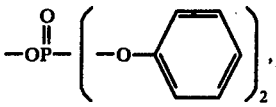

$—SCH_3, —SC_2H_5, —S—CCH_3, —S—C—CH_3,$
$—SCOCH_3, —SC—OC_2H_5, —SCN(CH_3)_2,$
$—NHCH_3, —N(CH_3)_2, NHC—CH_3,$
$—NHC—NH_2, —NHC—OC_2H_5,$
$—NH—C—NH_2, —NH—C—NH—C—NH_2$

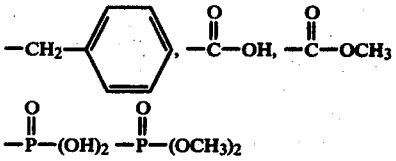

Non-limiting examples of particular compounds of structure I are where n=2 or 3 and R is monocyclic 1,4-bis hydroxymethyl benzene
1,4-bis methoxymethyl benzene
1,4-bis benzoxymethyl benzene
1,4-bis chloromethyl benzene
1,4-bis acetyloxymethyl benzene
2,4,6-tris chloromethyl mesitylene
3,6-bis methoxymethyl durene
2,4,6-tris acetoxymethyl mesitylene
2,6-bis hydroxymethylpyridine
1,3,5-tris hydroxymethyl benzene
1,4-bis hydroxymethyl-2,3,5,6 tetrachlorobenzene where n=2 and R is non-condensed bicyclic 4,4¹-bis(chloromethyl)biphenyl
4,4¹-bis(bromomethyl)biphenyl
4,4¹-bis(hydroxymethyl)biphenyl
4,4¹-bis(methoxymethyl)biphenyl
4,4¹-bis(phenoxymethyl)biphenyl
4,4¹-bis(benzyloxymethyl)biphenyl
4,4¹-bis(acetoxymethyl)biphenyl
4,4¹-bis(formyloxymethyl)biphenyl
4-hydroxymethyl-4¹-methoxymethyl biphenyl
4-hydroxymethyl-4¹-acetoxymethyl biphenyl
4,4¹-bis(dimethylaminomethyl)biphenyl
4,4¹-bis(methylcarbamoyloxymethyl)biphenyl
4,4¹-bis(hydroxymethyl)diphenyl methane
4,4¹-bis(methoxymethyl)diphenyl methane
4,4¹-bis(benzyloxymethyl)diphenyl methane
4,4¹-bis(formyloxymethyl)diphenyl methane
4,4¹-bis(carbamoyloxymethyl)diphenyl methane
4,4¹-bis(hydroxymethyl)benzophenone
4,4¹-bis(hydroxymethyl)diphenyl ether
4,4¹-bis(methoxymethyl)diphenyl ether
4,4¹-bis(acetyloxymethyl)diphenyl ether 4,4[1]-bis(hydroxymethyl)diphenyl sulphone
N,N-bis(4-hydroxymethyl phenyl)methylamine
bis(4-hydroxymethyl phenyl)octyl phosphate
4,4[1]-bis(methoxymethyl)-3,3[1]-dimethyl diphenyl where n=2 and R is condensed bicyclic 1,5-bis(chloromethyl)naphthalene
1,5-bis(hydroxymethyl)naphthalene
1,5-bis(methoxymethyl)naphthalene
1,5-bis(formyloxymethyl)naphthalene
5,8-bis(chloromethyl)tetralin
5,8-bis(hydroxymethyl)tetralin
5,8-bis(methoxymethyl)tetralin
4,8-bis(chloromethyl)quinoline
5,8-bis(hydroxymethyl)quinoline 4,8-bis(methoxymethyl)quinoline
4,8-bis(hydroxymethyl)isoquinoline
4,8-bis(acetoxymethyl)isoquinoline
5,8-bis(chloromethyl)quinoxaline
5,8-bis(hydroxymethyl)quinoxaline
5,8-bis(formyloxymethyl)quinoxaline
5,8-bis(chloromethyl)phthalazine
3,6-bis(chloromethyl)phthalimide
4,7-bis(hydroxymethyl)indole
4,7-bis(methoxymethyl)indole
4,7-bis(hydroxymethyl)benzofuran 4,7-bis(methoxymethyl)benzofuran
4,7-bis(chloromethyl)benzofuran
4,7-bis(hydroxymethyl)benzotriazole 4,7-bis(formyloxymethyl)benzotriazole where n=2 or 3 and R is non-condensed tricyclic 1,4-di(p-chloromethyl phenyl)benzene
1,4-di(p-hydroxymethyl phenyl)benzene
1,4-di(p-formyloxymethyl phenyl)benzene
tri(p-methoxymethyl phenyl)methane
tri(p-hydroxymethyl phenyl)methane
tri(p-chloromethyl phenyl)methane
1,4-di(p-methoxymethyl benzyl)benzene
1,4-di(p-hydroxymethyl benzyl)benzene
1,4-di(p-formyloxymethyl benzyl)benzene
1,4-di(p-chloromethyl benzyl)benzene
1,4-di(p-acetoxymethyl benzyl)benzene
O,O[1]di(p-chloromethyl phenyl)hydroquinone
O,O[1]di(p-methoxymethyl phenyl)hydroquinone
O,O[1]di(p-benzoyloxymethyl phenyl)hydroquinone
O,O[1]di(p-dimethyl aminomethyl phenyl)resorcinol
tri(p-hydroxymethyl phenyl)amine
tri(p-methoxymethyl phenyl)amine
tri(p-formyloxymethyl phenyl)phosphine
tri(p-benzoyloxymethyl phenyl)phosphine
tri(p-carbamoyloxymethyl phenyl)phosphine
tri(p-dimethyl aminomethyl phenyl)phosphine oxide
tri(p-bromomethyl phenyl)phosphine oxide
tri(p-benzoyloxymethyl phenyl)phosphine oxide
tri(p-chloromethyl phenyl)phosphate
tri(p-methoxymethyl phenyl)phosphate
di(p-hydroxymethyl phenyl)mono(p-methoxymethyl phenyl)phosphate
tri(p-methoxymethyl-meta-cresyl)phosphate
mono-phenyl di(p-methoxymethyl phenyl)phosphate
mono-phenyl,mono(p-hydroxymethyl phenyl), mono(p-methoxymethyl phenyl)phosphate
di(methoxymethyl phenyl), mono(o-isopropyl phenyl)phosphate
di(hydroxymethyl phenyl)-mono(p-isopropyl phenyl)phosphate
di(2-isopropyl-4-methoxymethyl phenyl)phenyl phosphate
di(hydroxymethyl phenyl), mono(m-isopropyl phenyl)phosphate
tri(p-methoxymethyl phenyl)antimony
tri(p-hydroxymethyl phenyl)antimony where n=2, 3 or 4 and R is condensed tricyclic 1,4-di-hydroxymethyl anthracene
5-hydroxymethyl-1,4-di(methoxymethyl)anthracene
1,4-di-(hydroxymethyl)-5,8-di(methoxymethyl)anthracene
2,7-di(acetoxymethyl)anthracene
1,4,7-tris(acetoxymethyl)acenaphthylene
1,4,7-tris(dimethyl aminomethyl)acenaphthylene
1,4,5,8-tetra(hydroxymethyl)fluorene
1,4,5,8-tetra(acetoxymethyl)xanthene
1,4,5-tri(bromomethyl)xanthene
1,4,5,8-tetra(dimethyl aminomethyl)carbazole
1,4,5,8-tetra(carbamoyloxymethyl)acridine
1,4,6,9-tetra(benzoyloxymethyl)phenazine
2,7,10-tris(chloromethyl)phenanthridine
1,4,6,9-tetra(methoxymethyl)phenoxazine
1,4,6,9-tetra(hydroxymethyl)phenothiazine
1,3,3-tri-methyl-1-phenyl-4,7-di(methoxymethyl)indane where n=3 to 8 and R is non-condensed tetracyclic tetra(3,5-di-hydroxymethyl phenyl)methane
tetra(4-methoxymethyl phenyl)methane
tetra(4-formyloxymethyl phenyl)methane
tetra(4-dimethyl aminomethyl phenyl)methane
1,3,5-tri(3,5-di-chloromethyl phenyl)benzene
1,3,5-tri(4-methoxymethyl phenyl)benzene
1,3,5-tri(4-carbamoyloxymethyl phenyl)benzene
1,3,5-tri(4-benzoyloxymethyl phenyl)benzene
N,N[1],N[11]-tri(3,5-di-hydroxymethyl phenyl)melamine
N,N[1],N[11]-tri(3,5-di-formyloxymethyl phenyl)melamine
N,N[1],N[11]-tri(4-methoxymethyl phenyl)melamine
2,4,6-tri(3,5-di-chloromethyl phenyl)triazine
2,4,6-tri(3,5-di-carbamoyloxymethyl phenyl)triazine
2,4,6-tri(4-acetoxymethyl phenyl)triazine
N,N[1],N[11]-tri(3,5-dihydroxymethyl phenyl)isocyanurate
tetra(3,5-diformyloxymethyl phenyl)tin
tetra(4-hydroxymethyl phenyl)tin
tetra(4-chloromethyl phenyl)tin
tetra(4-acetoxymethyl phenyl)lead
tetra(4-bromomethyl phenyl)lead
tetra(4-methoxymethyl phenyl)lead where n=2 to 3 and R is condensed tetracyclic 2-phenyl-5,8-di-bromomethyl anthracene
2-phenyl-5,8-di-hydroxymethyl anthracene
2-phenyl-5,8-di-formyloxymethyl anthracene
3-phenyl-3,6-dimethoxymethyl phenanthrene
3-phenyl-3,6-di-acetoxymethyl phenanthrene
3-phenyl-3,6-di-hydroxymethyl phenanthrene
N-phenyl-2,6-di-chloromethyl carbazole
N-phenyl-2,6-di-carbamoyloxymethyl carbazole
N-phenyl-2,7-di-methoxymethyl phenothiazine
N-phenyl-2,4,6-tri-bromomethyl phenothiazine
N-phenyl-2,4,6-tri-acetoxymethyl phenoxazine
2,3-diphenyl-5,8-di-formyloxymethyl quinoxaline
2,3-diphenyl-5,8-di-hydroxymethyl quinoxaline where n=2 to 6 and R is polycyclic higher than tetracyclic 2,6-di-methoxymethyl-9,10-diphenyl anthracene
2,8-di-chloromethyl rubrene
2,6-di-hydroxymethyl-9,9-diphenyl xanthene
2,6-di-acetoxymethyl-9,9-diphenyl xanthene
2,6-carbamoyloxymethyl-9,9-diphenyl xanthene
1,4,6,9,12,15-hexa-methoxymethyl hexacene Non limiting examples of the phosphorus acid esters of formula II where m=0 cresyl diphenyl phosphate
phenyl xylyl phosphates
tri-cresyl phosphate
tri-xylyl phosphate
tri-m-ethylphenyl phosphate
phenyl/isopropyl phenyl phosphates
phenyl/sec-butyl phenyl phosphates
phenyl/p-t-butyl phenyl phosphates
di-phenyl, αα-dimethyl benzyl phenyl phosphate
di-phenyl, p-nonyl phenyl phosphate
di-phenyl, p-t-amyl phenyl phosphate
phenyl di(p-chloro phenyl) phosphate
phenyl/cumenylphenyl/nonylphenyl phosphates
isopropylphenyl/cumenylphenyl phosphates
isopropylphenyl/styrenylphenyl phosphates Where m=1 diphenyl, 2-chloroethyl phenyl phosphate
diphenyl, 2,3-dichloropropyl phenyl phosphate
diphenyl butyl phosphate
diphenyl octyl phosphate
diphenyl decyl phosphate
diphenyl hexadecyl phosphate
dicresyl-2-ethyl hexyl phosphate
butoxy ethyl diphenyl phosphate
benzoxyethyl diphenyl phosphate
2-ethyl hexyl phenyl cresyl phosphate
di(isopropyl phenyl)-2-ethyl hexyl phosphate
di(-o-chlorophenyl)-2-ethyl hexyl phosphate Where m=2 di-n-octyl cresyl phosphate
di(2-chloroethyl) phenyl phosphate
di(2-ethylhexyl) phenyl phosphate Where m=3 tri-propyl phosphate
tri butyl phosphate
tri-2-ethyl hexyl phosphate
tri-n-decyl phosphate
tri-butoxy ethyl phosphate
tri-2-chloro ethyl phosphate The amounts of phosphoric acid ester (a) to $R(CH_2X)_n$ compound (b) may vary over a wide range. The compositions may contain from 1 to 100 parts of (b) per 100 parts of (a) but preferably 3 to 50 parts of (b) per 100 parts of (a) and most preferably 5 to 25 parts of (b) per 100 parts of (a).

Mixtures of compounds of type (a) may also be used with mixtures of compounds of type (b). The compositions may, if required, be mixed with other functional fluids, for example mineral oil, carboxylate esters, chlorinated biphenyl, synthetic hydrocarbons, polyglycols, polyglycol ethers, silicones and poly (phenyl ethers).

The preferred phosphorus acid esters are phosphates such as phenyl/isopropyl phenyl phosphates, phenyl/p-t-butyl phenyl phosphates, phenyl/sec-butyl phenyl phosphates, tri-cresyl phosphate, cresyl diphenyl phosphate, trixylylphosphate, phenyl/α,α-dimethyl benzyl phenyl phosphates, phenyl/nonyl phenyl phosphates, phenyl/cumenylphenyl/nonylphenyl phosphates, isopropylphenyl/cumenylphenyl phosphates and isopropylphenyl/styrenylphenyl phosphates. The phosphate is preferably a liquid.

Compounds of type (b) which are particularly preferred are those of formulae

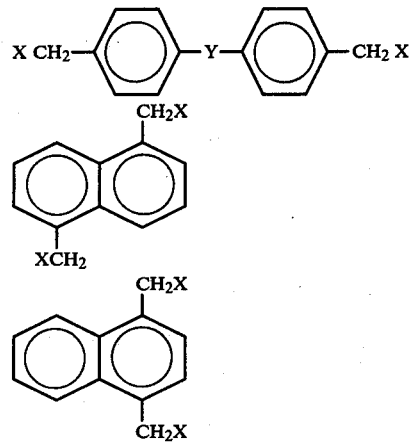

and $(A)_a(—CH_2—)_b[—CH_2(OCH_2)_eOCH_2—]_c(CH_2X)_d$ where A is a naphthalene residue, X represents Cl, OH or $OR^1$, preferably methoxy, ethoxy or butoxy, or acyloxy, or acetoxy, a, b, c, d and e are as defined previously and Y represents a direct link or oxygen. These compounds are preferably used in admixture with aromatic phosphates or halo-alkyl phosphates or aryl halo-alkyl phosphates or mixtures thereof. Most preferred are mixtures of compounds of the above structure and aromatic phosphates.

The compositions of the invention may also contain dyes, antioxidants, metal passivators/corrosion inhibitors, rust inhibitors, additives for improving hydrolytic stability, viscosity index improvers, extreme pressure/anti wear additives, pour point depressants, dispersants or detergents and anti foams.

Example of antioxidants which may be used include the tertiary alkyl-phenyl α- and β-naphthylamines described and claimed in British Patent Specification No. 1,046,353 and their mixtures with dioctyl diphenylamine as described in British Patent Specification No. 1,180,385; oxidised amines as described in British Patent Specification No. 1224556; other alkylated and nonalkylated aromatic amines and mixtures thereof; e.g. N-phenyl-α-naphthyl-amine, phenothiazine; hindered phenols such as 2,6-di-tertiary-butyl p-cresol, 4,4'-bis-(2,6-tert-butylphenol), and 2,2'-thio-bis-(4-methyl-6-t-butylphenol); alkyl, aryl or alkaryl phosphites such as triphenyl phosphite, tridecyl phosphite and diphenyldecylphosphite, esters of thiopropionic acid for instance dilauryl thiodipropionate; salts of carbamic or dithiophosphoric acid, for example antimony diamyl-dithiocarbamate and zinc diamyldithiophosphate; free radical antioxidant and their precursors such as amine oxides and nitroxides; metal complexants e.g. metal salts and complexes of organic chelating agents such as copper bis-(trifluoroacetylacetonates) copper phthalocyanines and the mono sodium salt of the tributyl ester of E.D.T.A.

Examples of suitable metal passivators include those of the following types:

(1) for copper; for example, benzotriazole, 5,5'-methylene-bisbenzotriazole, tetrahydrobenzotriazole, 2,5-dimercapto-thiadiazole, salicylidene-propylene-diamine, salts of salicylalaminoguanidine and quinizarin;

(2) for magnesium; for example, propyl gallate (3) for lead; for example, sebacic acid Rust inhibitors which may be employed in the lubricant compositions include those of the following groups:

(1) Organic acids, and their esters, metal or amine salts, for example N-oleoyl sarcosine, sorbitan monooleate, lead naphthenate and esters or amine salts of dodecenylsuccinic acid.

(2) Nitrogen containing materials, for example (2.1) primary, secondary or tertiary aliphatic or cycloaliphatic amines and amine salts of organic and inorganic acids, for example morpholine, stearyl amine and triethanolamine caprylate.

(2.2) heterocyclic compounds, for example, imidazolines, and oxazolines;

(3) Phosphorus containing materials, for example inorganic phosphates, phosphonic acid and amine phosphates.

(4) Sulphur containing materials, for example barium dinonylnapthalene sulphonates.

Suitable viscosity index improvers or pour point depressants are, for instance, polyacrylates and polybutenes. Additional extreme pressure or antiwear additives appropriate for use in the lubricant composition include sulphur and/or phosphorus containing materials for instance sulphurised sperm oil, olefins, triaryl phosphites, etc.

Non-limiting examples of compositions containing (a) and (b) are listed below.

4,4'-bis-methoxymethyl biphenyl and Phosphate A 4,4'-bis-acetoxymethyl biphenyl and Phosphate B 4,4'-bis-ethoxymethyl biphenyl and Phosphate A 4,4'-bis-methoxymethyl diphenyl ether and Phosphate A 4,4'-bis-acetoxymethyl diphenyl ether and Phosphate C 4,4'-bis-acetoxymethyl biphenyl and tri-tolyl phosphate 4,4'-bis-methoxymethyl biphenyl and cresyl diphenyl phosphate 4,4'-bis-butoxymethyl biphenyl and tri-xylyl phosphate 4,4'-bis-methoxymethyl diphenyl ether and phenyl/p-t-butyl phenyl phosphate 4,4'-bis-acetoxymethyl biphenyl and phenyl/p-t-butyl phenyl phosphate (Phosphate A is a triaryl phosphate based on an isopropylphenol/phenol alkylate containing 0.8 moles propylene/moles phenol Phosphate B is a triaryl phosphate based on an isopropylphenol/phenol alkylate containing 0.725 moles propylene/moles phenol Phosphate C is a triaryl phosphate based on an isopropylphenol/phenol alkylate containing 0.525 moles propylene/moles phenol prepared as described in British Pat. No. 1,146,173).

The most preferred compositions are produced from liquid phosphates and a compound of type (b) derived from at least a bicyclic residue.

Compositions of the present invention may be used for a wide variety of purposes, for example in hydraulic machinery employed in foundries and mines, in hydraulic systems for aircraft, in turbines and as fluids in electrical equipment, e.g. transformers, condensors, capacitors and in heat transfer devices.

The aromatic compounds of formula $R(CH_2X)_n$ used in the present invention can be readily prepared by well established methods. For example the parent aromatic compound may be reacted with formaldehyde or chloromethylated by reaction with formaldehyde and hydrogen chloride gas. This reaction is described in "Organic Reactions," Vol. I, 63 (1942). Displacement of the chlorine atom by other nucleophiles can give other compounds of the present invention.

Examples of these reactions are:

$$R.CH_2Cl + KOH + CH_3OH \rightarrow R.CH_2OCH_3$$

$$R.CH_2Cl + CH_3COOK \rightarrow R.CH_2OCOCH_3$$

$$R.CH_2Cl + KCN \rightarrow R.CH_2CN$$

$$R.CH_2Cl + (CH_3)_2NH \rightarrow R.CH_2N(CH_3)_2$$

$$R.CH_2Cl + (C_2H_5)_2NC(=S)-S-Na \longrightarrow R.CH_2SC(=S)N(C_2H_5)_2$$

$$R.CH_2Cl + HCOONa \rightarrow R.CH_2OOCH$$

$R.CH_2Cl$ compounds may also be prepared by side-chain chlorination of methyl groups, i.e. by reaction of $R.CH_3$ compounds with chlorine gas.

Groups other than $—CH_2Cl$ may be introduced directly into an aromatic nucleus by one stage reactions. Reactions of this type are reviewed in "Formation of C—C Bonds," Vol I by Jean Mathieu and Jean Weill-Raynal. Examples of $CH_2X$ groups which may be directly introduced into an aromatic nucleus are: $—CH_2Cl$, $—CH_2OH$, $—CH_2OCH_3$, $—CH_2OCOCH_3$, $—CH_2SC_2H_5$, $—CH_2SC_6H_5$, $—CH_2N(CH_3)_2$, $—CH_2N(C_2H_5)_2$.

Compounds of the present invention may be an oligomer which can be prepared by conventional methods; examples of which are:

(1) the reaction of naphthalene with formaldehyde in the presence of an acid catalyst to produce oligomers with structures having methylene ($—CH_2—$), acetal ($—(CH_2O)_n—CH_2—$) links and di-methylene ether links ($—CH_2—O—CH_2—$), or (2) by the chloromethylation of naphthalene to produce mixtures of mono, di and higher chloromethyl naphthalenes which are then hydrolysed and oligomerised to produce oligomers having predominently dimethylene ether ($—CH_2—O—CH_2—$) and methylene ($—CH_2—$) links, or (3) by reacting a chloromethylated aromatic compound, e.g. benzyl chloride, with formaldehyde or a precurser thereof, such as trioxymethylene and an acid catalyst to give a chloromethylated diaryl methane, e.g. bis-chloromethyl di-phenylmethane.

The latter are hydrolysed and oligomerised with aqueous sodium carbonate or are converted, via the acetoxymethyl compounds, into the hydroxymethyl derivatives and then oligomerised with an acid catalyst.

More detailed methods of preparation of compounds of the invention are given below:

Method A: bis-hydroxymethyl bis-phenol A or 2,2-bis - (3-hydroxymethyl-4-hydroxy-phenyl)-propane To a mixture of 1.5 mole bis -phenol A, 3.3 mole sodium hydroxide and 1200 g. of water, was added 3.75 mole formaldehyde (as a 37% w/w aqueous solution). The resulting solution was stirred at room temperature for 43 hours. After neutralising the reaction mixture with dilute hydrochloric acid, the product was precipitated as a plastic solid which was dissolved in ether. The ether layer was dried, and the solvent removed by distillation at 60° C. and 20 mm mercury pressure. The product was a brown solid, melting range 45°–65° C. (1.48 moles, 98% of theory).

Method B: 2,4- bis-Hydroxymethyl-6-phenyl-phenol

To a mixture of 0.94 mole of 2-phenyl-phenol, 1.03 mole sodium hydroxide and 280 g. of water, was added 2.34 mole formaldehyde (as a 37% w/w aqueous solution). The reaction mixture was stirred for 46.5 hours at room temperature. It was then diluted with 1.51. of cold water and a small amount of resinous material filtered off and discarded. The dark red filtrate was neutralised with 18% w/w hydrochloric acid which produced a further small amount of resinous solid and a white solid. The former was removed and discarded, the latter was filtered off, washed with cold water and then dried in a vacuum oven at 50° C. and 20 mm mercury pressure. The product was a pale pink solid, melting range 105°–110° C. (0.67 moles, 71% of theory).

Method C: Preparation of aromatic hydrocarbon oligomers (a) Chloromethylation of aromatic hydrocarbons This reaction is carried out in an efficient fume cupboard because of the possible formation of bis-chloromethyl ether in the vapour phase above the reaction mixture.

A 5 liter four-neck round bottom flask is fitted with a stirrer, thermometer, gas inlet tube and a reflux condenser. The off-gas from the reaction is conveyed to a scrubber in which 2 liters of water is continuously circulated and maintained alkaline to phenolphthalein by addition of 46% w/w aqueous sodium hydroxide as required.

The reactants naphthalene 4 moles of formaldehyde as 37% aqueous solution 28 moles are charged to the flask and heated and stirred at 90° C. for the time required to achieve a chloromethylation level of 1.50. During this period, hydrogen chloride gas is passed into the reaction mixture at the rate of 320 ml/min (13.8 moles). The progress of chloromethylation is monitored by NMR analysis.

Passage of hydrogen chloride and stirring is stopped and the reaction mixture allowed to cool to room temperature. The aqueous layer is removed and the crude product washed with two 1000 g. portions of cold water. The crude product is an off-white solid.

(b) Hydrolysis of chloromethylated aromatic hydrocarbon using aqueous sodium carbonate Example To the crude chloromethylated naphthalene is added 0.77 moles anhydrous sodium carbonate per mole of chloromethyl naphthalene and 786 g. of water for every g. mol. of anhydrous sodium carbonate. The reaction mixture is stirred and heated at 100° C. for eight hours.

The amount of sodium hydroxide required is 0.2625 mole/mole chloromethyl naphthalene added as a 46% w/w aqueous solution. Heating and stirring at 100° C. is continued for a further 6 hours. The mixture is allowed to cool and the aqueous phase removed by decantation. The organic phase is washed twice with water at 60° C. and finally dried by heating and stirring for three hours at 110° C. and 20 mm. mercury pressure. An 80% yield was achieved of an oligomer having a molecular weight of 550.

The following examples listed in Tables 1 and 2 further illustrate the invention. The liquid compositions were prepared by dissolving the stated amounts of compound I (by weight) in the phosphorus acid esters A (viscosity 23.5–26.5 cs at 50° C.) and D (viscosity 47–53 cs at 25° C.) described in British Pat. No. 1,146,173. The composition was then tested in a Wick Test as follows:

A length of woven asbestos tape was soaked in the fluid and then placed in a reservoir of the fluid with one edge exposed forming a wick. A small acetylene flame was applied to the exposed edge of the wick for 5 seconds, and the persistence of flame on the wick after removal of the igniting flame was measured.

Examination of Table 1 shows that the performance of the Phosphate A fluid in the Wick Test is markedly improved when a compound of formula I is added. In Table 2 a phosphate ester Phosphate D (65 parts) is used in conjunction with di-octyl sebacate (35 parts). Compositions of the invention, Examples 7 to 16, show a marked reduction in burning time compared to the blank (Example B).

TABLE I

| Example No. | R | X | n | General Method of Preparation | M.Pt. or B.Pt °C. | Parts of Compound I | Parts of Phosphate A | Wick Test (secs) |
|---|---|---|---|---|---|---|---|---|
| Comparative Example A | — | — | — | — | | — | 100 | 19 |
| 1 | 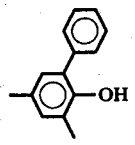 | OH | 2 | B | 105–110 | 5 | 95 | 10 |

TABLE I-continued

| Example No. | R | X | n | General Method of Preparation | M.Pt. or B.Pt °C. | Parts of Compound I | Parts of Phosphate A | Wick Test (secs) |
|---|---|---|---|---|---|---|---|---|
| 2 | 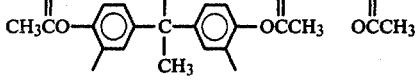 | O<br>‖<br>OCCH3 | 2 | A | Viscous oil | 10 | 90 | 10 |
| 3 | Naphthalene oligomer M. Wt. 550 | OH | >2 | C | 50–60 | 10 | 90 | 4 |
| 4 | " | " | " | " | " | 5 | 95 | 10 |
| 5 | " | " | " | " | " | 2.5 | 97.5 | 11 |
| 6 | " | " | " | " | " | 1 | 99 | 12 |

TABLE 2

| Example No. | R | X | n | General Method of Preparation | M Pt or B Pt °C. | Parts of Compound I | Wick Test (secs) |
|---|---|---|---|---|---|---|---|
| Comparative Example B | — | — | — | — | — | — | 55 |
| 7 | 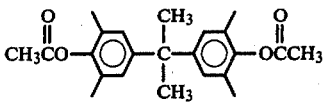 | O<br>‖<br>—OCCH3 | 4 | A | 43–60 | 5 | 16 |
| 8 | 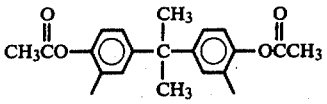 | " | 2 | A | | 10 | 20 |
| 9 | 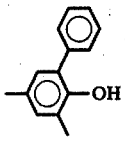 | OH | 2 | B | 105–110 | 5 | 27 |
| 10 | " | OH | 2 | B | 11 | 10 | 22 |
| 11 | Phenolic Resole prepared from phenol alkenylated to 0.725 moles propylene/mole phenol at 140° C. using acid catalyst and 1.25 mol HCHO and 0.5 mole butanol using $NH_3$ catalyst | OH | 1–2 | | | 10 | 25 |
| 12 | Naphthalene oligomer M. Wt. 550 | OH | >2 | C | 50–60 | 10 | 13 |
| 13 | " | " | " | " | " | 5 | 17 |
| 14 | " | " | " | " | " | 2.5 | 18 |
| 15 | " | " | " | " | " | 1 | 19 |
| 16 | " | " | " | D | " | 10 | 29.3 |

What we claim is:

1. A functional fluid composition comprising (a) a phosphorus acid ester of formula II

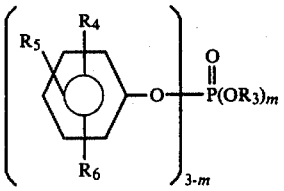

(II)

in which m is an integer from 0 to 3, $R_4$, $R_5$ and $R_6$, which may be the same or different, are hydrogen, alkyl having 1 to 9 carbon atoms, cycloalkyl having 6 to 12 carbon atoms, haloalkyl having 1 to 9 carbon atoms, but excluding halomethyl, said haloalkyl groups containing one or more chlorine atoms, chloro, aryl having 6 to 10 carbon atoms or aralkyl having 7 to 12 carbon atoms, and $R_3$ is alkyl having 1 to 16 carbon atoms or haloalkyl containing one or more chlorine atoms; and (b) a compound of formula I $$R(CH_2X)_n \quad (I)$$

in which

R represents an aromatic hydrocarbon or aromatic heterocyclic containing residue, n is an integer of at least 2, and each X is the same or different and represents halo, OH, SH, $NH_2$, COOH, $PO_3H_2$, $OB(OH)_2$, $OR^1$, $SR^1$, $NHR^1$, $NR^1R^2$, $OB(OR^1)(OR^2)$,

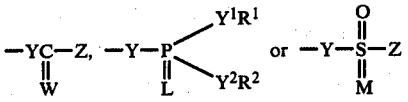

where Y, $Y^1$ and $Y^2$ are independently —O—, —NH—, —$NR^1$—, —S— or a direct bond, Z is hydrogen, $R^1$, $OR^1$, $SR^1$, $NH_2$, $NHR^1$, $NR^1R^2$ or a direct bond linking

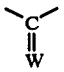

to R or to a $CH_2$ attached to R,

W is O, S, NH or $NR^1$,

L is O, S or is absent,

M is O, S or is absent, and $R^1$ and $R^2$ are independently a straight or branched chain alkyl having 1 to 12 carbon atoms, alkenyl having 2 to 12 carbon atoms, alkynyl having 2 to 12 carbon atoms, cycloalkyl having 5 to 12 carbon atoms, cycloalkenyl having 5 to 12 carbon atoms, aralkyl having 7 to 12 carbon atoms, araalkenyl having 7 to 12 carbon atom or alkaryl having 7 to 12 carbon atoms.

2. A composition according to claim 1 in which R in formula I a condensed or non-condensed monocyclic, dicyclic or polycyclic residue.

3. A composition according to claim 1 in which the compound of formula I is

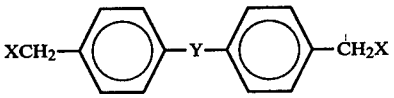

where

X represents chloro, OH, $OR^1$ or $OCOR^1$, $R^1$ is a straight or branched chain alkyl having 1 to 12 carbon atoms, alkenyl having 2 to 12 carbon atoms, alkynyl having 2 to 12 carbon atoms, cycloalkyl having 5 to 12 carbon atoms, cycloalkenyl having 5 to 12 carbon atoms, aralkyl having 7 to 12 carbon atoms, aralkenyl having 7 to 12 carbon atoms or alkaryl having 7 to 12 carbon atoms, and Y represents a direct bond or O.

4. A composition according to claim 1 in which the compound of formula I is

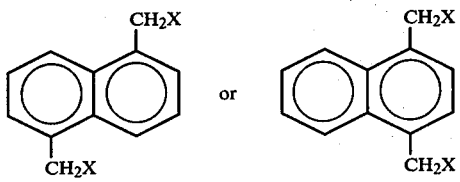

where

X represents chloro, OH, $OR^1$ or $OCOR^1$, and $R^1$ is a straight or branched chain alkyl having 1 to 12 carbon atoms, alkenyl having 2 to 12 carbon atoms, alkynyl having 2 to 12 carbon atoms, cycloalkyl having 5 to 12 carbon atoms, cycloalkenyl having 5 to 12 carbon atoms, aralkyl having 7 to 12 carbon atoms, aralkenyl having 7 to 12 carbon atoms or alkaryl having 7 to 12 carbon atoms.

5. A composition as claimed in claim 1, in which at least one of $R_4$, $R_5$ and $R_6$ in formula II is methyl, isopropyl, tert-butyl or tert-nonyl.

6. A composition as claimed in claim 1, in which R is substituted by one or more halogen atoms, alkyl groups having 1 to 12 carbon atoms, alkenyl or alkynyl groups having 2 to 12 carbon atoms, cycloalkyl groups having 5 to 12 carbon atoms, hydroxyl groups, alkoxy groups having 1 to 12 carbon atoms which may contain an epoxide group, cycloalkoxy groups having 5 to 12 carbon atoms, acyloxy groups having 1 to 12 carbon atoms, carboxyl groups or carboalkoxy groups having 2 to 12 carbon atoms, or mixtures thereof.

7. A composition as claimed in claim 1, in which R is an otherwise unsubstituted di-, tri- or tetracyclic aromatic residue.

8. A composition as claimed in claim 1, which also contains a dye, antioxidant, metal passivator, corrosion inhibitor, rust inhibitor, additives for improving hydrolytic stability, viscosity index improver, extreme pressure/anti wear additive, pour point depressant, dispersant, detergent, or antifoam, or mixtures thereof.

9. A composition as claimed in claim 1, which also contains a mineral oil, carboxylate ester, chlorinated biphenyl, synthetic hydrocarbon, polyglycol, polyglycol ether, silicone or poly(phenyl ether), or mixtures thereof.

10. A composition as claimed in claim 9, which contains a carboxylic acid ester.

11. A functional fluid composition comprising (a) a phosphorus acid ester of formula II

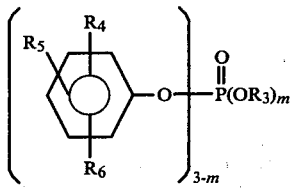

(II)

in which m is an integer from 0 to 3.

$R_4$, $R_5$ and $R_6$, which may be the same or different, are hydrogen, alkyl having 1 to 9 carbon atoms, cycloalkyl having 6 to 12 carbon atoms, haloalkyl having 1 to 9 carbon atoms, but excluding halomethyl, said haloalkyl groups containing one or more chlorine atoms, chloro, aryl having 6 to 10 carbon atoms or aralkyl having 7 to 12 carbon atoms, and $R_3$ is alkyl having 1 to 16 carbon atoms or haloalkyl containing one or more chlorine atoms; and (b) an oligomer of the formula $$(A)_a(—CH_2—)_b\,[—CH_2(OCH_2)_eOCH_2—]_c\,(—CH_2X)_d$$

wherein

A is at least one aromatic hydrocarbon or aromatic heterocyclic residue, X is OH, $OB(OH)_2$, $OR^1$, $OB(OR^1)(OR^2)$,

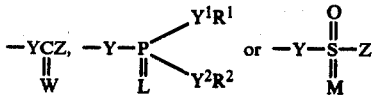

where Y, $Y^1$ and $Y^2$ are O,

Z is hydrogen, $R^1$, $OR^1$, $SR^1$, $NH_2$, $NHR^1$, $NR^1R^2$ or a direct bond linking

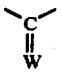

to A or to a $CH_2$ attached to A,

W is O, S, NH or $NR^1$,

L is O, S or is absent,

M is O or is absent, and $R^1$ and $R^2$ are independently a straight or branched chain alkyl having 1 to 12 carbon atoms, alkynyl having 2 to 12 carbon atoms, cycloalkenyl having 5 to 12 carbon atoms, aralkyl having 7 to 12 carbon atoms, aralkenyl having 7 to 12 carbon atoms or aralkyl having 7 to 12 carbon atoms, a is 2 to 20, but equals b+c+1, b is 0 to 19, c is 0 to 19, e is 0 to 10, and d is 0 to 2*a*, but with the proviso that when c is 0, d must be at least 2, and when c is 1, d must be at least 1, so that thereare at least two (—CH X) groups per molecule, the (—$CH_2OCH_2$—) group counting as (—$CH_2X$) for this purpose.

12. A composition as claimed in claim 11, in which the residues A of the oligomer are derived from naphthalene and are linked by (-$CH_2OCH_2$—) groups at the 1,4 or 1,5 positions on the naphthalene residue.

13. A composition as claimed in claim 11 in which at least one of $R_4$, $R_5$ and $R_6$ in formula II is methyl, isopropyl, tert-butyl or tert-nonyl.

14. A composition as claimed in claim 11 which also contains a dye, antioxidant, metal passivator, corrosion inhibitor, rust inhibitor, an additive for improving hydrolytic stability, viscosity index improver, extreme pressure/anti wear additive, pour point depressant, dispersant, detergent or antifoam, or mixtures thereof.

15. A composition as claimed in claim 11 which also contains a mineral oil, carboxylate ester, chlorinated biphenyl, synthetic hydrocarbon, polyglycol, polyglycol ether, silicone or poly(phenyl ether), or mixtures thereof.

16. A composition as claimed in claim 15 which contains a carboxylic acid ester.

* * * * *